US012385194B2

(12) United States Patent
Erdtmann et al.

(10) Patent No.: US 12,385,194 B2
(45) Date of Patent: Aug. 12, 2025

(54) ROAD FINISHER WITH LIGHTING

(71) Applicant: JOSEPH VOEGELE AG, Ludwigshafen/Rhein (DE)

(72) Inventors: Bernhard Erdtmann, Mannheim (DE); Thomas Seither, Waldsee (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 970 days.

(21) Appl. No.: 17/492,177

(22) Filed: Oct. 1, 2021

(65) Prior Publication Data

US 2022/0106745 A1 Apr. 7, 2022

(30) Foreign Application Priority Data

Oct. 1, 2020 (DE) ..... 102020125680.9

(51) Int. Cl.
*E01C 19/48* (2006.01)
*E01C 23/01* (2006.01)

(52) U.S. Cl.
CPC ..... *E01C 19/48* (2013.01); *E01C 23/01* (2013.01); *E01C 2301/30* (2013.01); *E01C 2301/40* (2013.01)

(58) Field of Classification Search
CPC .. E01C 19/48; E01C 2301/01; E01C 2301/30; E01C 2301/40
USPC ..... 404/101, 118, 83
See application file for complete search history.

(56) References Cited

U.S. PATENT DOCUMENTS

| | | | | |
|---|---|---|---|---|
| 8,890,046 | B2 * | 11/2014 | Eul | E01C 19/48 250/205 |
| 9,073,460 | B2 | 7/2015 | Herzberg | |
| 9,963,838 | B2 | 5/2018 | Oettinger | |
| 10,087,588 | B2 | 10/2018 | Buschmann et al. | |
| 10,473,637 | B2 | 11/2019 | Schoenbach et al. | |
| 11,203,284 | B2 * | 12/2021 | Neisen | B60Q 1/247 |
| 2016/0101722 | A1 | 4/2016 | Kopea et al. | |
| 2017/0198445 | A1 * | 7/2017 | Oettinger | E01C 19/48 |

(Continued)

FOREIGN PATENT DOCUMENTS

| | | | |
|---|---|---|---|
| CN | 103031800 | A | 4/2013 |
| CN | 203270415 | U | 11/2013 |
| CN | 203498730 | U | 3/2014 |

(Continued)

OTHER PUBLICATIONS

Extended European Search Report for EP Patent Application No. 24150483.6-1005, dated Apr. 5, 2024, 7 Pages.

(Continued)

*Primary Examiner* — Raymond W Addie
(74) *Attorney, Agent, or Firm* — BROOKS KUSHMAN P.C.

(57) ABSTRACT

The road finisher comprises a material hopper for receiving paving material, a screed for compacting paving material, and a main control stand which provides an operating location for an operator on the road finisher. The main control stand comprises a floor area. The road finisher comprises a lighting unit. The lighting unit is no more than 140 cm higher with respect to a vertical direction than the floor area of the main control stand. The lighting unit is arranged such that at least 60 percent of the light output emitted by the lighting unit during operation falls onto the floor area of the main control stand.

15 Claims, 5 Drawing Sheets

(56) References Cited

U.S. PATENT DOCUMENTS

| | | | |
|---|---|---|---|
| 2017/0254031 | A1 | 9/2017 | Buschmann et al. |
| 2022/0106745 | A1 | 4/2022 | Erdtmann et al. |

FOREIGN PATENT DOCUMENTS

| | | | | |
|---|---|---|---|---|
| CN | 106414852 | A | 2/2017 | |
| CN | 107151967 | A | 9/2017 | |
| CN | 216739147 | U | 6/2022 | |
| DE | 102015008315 | A1 | 1/2017 | |
| EP | 2650437 | A2 * | 10/2013 | ..... B60K 37/06 |
| EP | 3 018 254 | A1 | 5/2016 | |
| EP | 2 650 197 | B1 | 9/2017 | |
| EP | 3 214 223 | A1 | 9/2017 | |
| EP | 3 149 245 | B1 | 1/2018 | |
| EP | 2 578 748 | B1 | 8/2018 | |
| JP | 2000129621 | A | 5/2000 | |
| JP | 2013014297 | A | 1/2013 | |
| WO | 2015/180774 | A1 | 12/2015 | |
| WO | 2021/108397 | A1 | 6/2021 | |

OTHER PUBLICATIONS

German Search Report Dated Aug. 4, 2021, Application No. 10 2020 125 680.9, Applicant Joseph Voegele Aktiengesellschaft, 6 Pages.

Chinese Search Report (with English Machine Translation) Dated Dec. 19, 2022,Application No. 202111168825.0, 6 Pages.

Chinese Office Action (with English Machine Translation) Dated Dec. 27, 2022,Application No. 202111168825.0, 17 Pages.

Third Office Action for Chinese Patent Application No. 202111168825.0, dated Feb. 2, 2024, 5 Pages (including English Translation).

European Search Report (with English Machine Translation) Dated Mar. 30, 2022, Application No. / Patent No. 21199892.7-1002 / 3988715, Applicant Joseph Voegele AG, 15 Pages.

* cited by examiner

ROAD FINISHER WITH LIGHTING

CROSS-REFERENCE TO RELATED APPLICATIONS

This application claims foreign priority benefits under 35 U.S.C. § 119(a)-(d) to German patent application number DE 102020125680.9, filed Oct. 1, 2020, which is incorporated by reference in its entirety.

TECHNICAL FIELD

The disclosure relates to a road finisher with a main control stand which provides an operating location for an operator on the road finisher.

BACKGROUND

From EP 3 214 223 A1, a road finisher for paving a road surface is known which comprises a material hopper located at the front in the paving travel direction for receiving paving material and a screed located at the rear in the paving travel direction for compacting the paving material. A workplace for an operator is provided on a driver's cab of the road finisher. The driver's cab is located at a central and elevated position on the road finisher and comprises a roof to protect the operator from the elements. A control panel with control elements is provided for controlling work components of the road finisher. The control elements may be operated by an operator seated on a driver's seat. A driver's cab lighting is provided to illuminate the driver's cab. The driver's cab lighting is provided at a support beam of the roof and shines from above into the occupational area of the operator in the driver's cab.

The inventors have recognized that this type of driver's cab lighting may have certain drawbacks when used on night construction sites. Due to the positioning and orientation of the driver's cab lighting, workers or other people in the vicinity of the road finisher may be blinded. In addition, passing road users may also be blinded. The operator in the driver's cab is directly illuminated by the driver's cab lighting and is therefore particularly clearly visible from the outside. This may lead to the operator feeling observed and unable to concentrate on his or her tasks in peace. Due to the positioning and orientation of the driver's cab lighting, considerable differences in brightness between the driver's cab and the surroundings of the road finisher may arise. The operator's eyes may adapt to the brightness in the driver's cab, as a result of which the operator's ability to look into darker areas in the vicinity of the road finisher is reduced. This may affect the operator's ability to monitor the paving process. In addition, impairments may arise if the operator cannot clearly see, for example, the movement of people in the region of the road finisher.

EP 2 578 748 B1 discloses a road finisher with an outer control stand provided behind the screed. The outer control stand is operated by a person walking along with the road finisher. A lighting device is integrated into a housing of a control panel of the outer control stand for illuminating a ground region arranged in front of, behind and/or under the outer control stand and to thus enable an obstacle on the ground traveled to be discovered.

EP 3 149 245 B1 describes a screed arrangement for a road finisher at which a work station for an operator is mounted. The work station comprises a floor plate on which the operator may stand. The workplace comprises a lighting unit for illuminating primarily the workplace itself and the outer region of the working width.

A road finisher with a driver's cab platform is known from EP 2 650 197 B 1. The road finisher comprises an operator's seat which may be pivoted between a first working position and a second working position. In the first working position, the seat is oriented approximately in the direction of travel of the road finisher and is located within a width of the driver's cab platform. In the second working position, on the other hand, the operator's seat is pivoted outward so that it projects beyond a lateral boundary of the driver's cab platform and is oriented at an angle to the direction of travel.

SUMMARY

It is an object of the disclosure to provide improved lighting for a road finisher.

According to an aspect of the disclosure, a road finisher comprising a material hopper for receiving paving material, a screed for compacting paving material, and a main control stand is provided. The main control stand provides an operating location for an operator on the road finisher. The main control stand comprises a floor area. The road finisher comprises a lighting unit. The lighting unit is arranged not more than 140 cm higher with respect to a vertical direction than the floor area of the main control stand. The lighting unit is arranged such that at least 60 percent of the light output emitted by the lighting unit during operation falls onto the floor area of the main control stand.

Due to the mounting height of no more than 140 cm above the floor area of the main control stand, an operator on the main control stand of the road finisher is typically not illuminated from above. In particular on night construction sites, this leads to reduced visibility of the operator from outside the road finisher and therefore to improved ease of use. The mounting height of the lighting unit of no more than 140 cm above the floor area of the main control stand also reduces the likelihood of the operator looking directly into the lighting unit and being blinded as a result. This applies to a standing operator as well as a seated operator. Directly visibility of the lighting unit from outside the road finisher is reduced due to the mounting height of no more than 140 cm above the floor area of the main control stand. This reduces the likelihood of workers or other people, in particular vehicle drivers, in the vicinity of the road finisher being blinded.

The floor area of the main control stand is particularly well illuminated because at least 60 percent of the light output emitted by the lighting unit during operation falls onto the floor area of the main control stand. This makes it easier for the operator to find his way around the main control stand even in the dark. In particular, the likelihood of the operator taking a wrong step is reduced due to the floor area being illuminated. The portion of light emitted onto the floor area of the main control stand is perceived as indirect illumination of the main control stand and therefore has a reduced risk of glare. Diffuse, i.e., non-blinding, illumination of the main control stand may be obtained by reflection of the light emitted onto the floor of the main control stand.

The road finisher preferably comprises a towing vehicle. The material hopper may be arranged at the towing vehicle. The screed may be pulled along behind the towing vehicle.

The main control stand is preferably arranged on the towing vehicle of the road finisher. The main control stand may be arranged in a central and/or elevated position on the towing vehicle of the road finisher. The main control stand may comprise an operating platform.

The main control stand may comprise a roof for protecting the operator from the elements. The main control stand may be an open control stand (not closed like a cabin) or a control stand that is closed like a cabin. The main control stand may comprise a fall protection, for example in, the form of a railing.

The lighting unit may comprise one or more light sources that generate visible light. The light sources may be electrical light sources. The light sources may, for example, be LEDs, lightbulbs, or gas discharge lamps. LEDs are preferred because of their low energy consumption and long service life. In particular, the light sources may be in the form of an LED strip which preferably extends along a transverse direction (transverse to the paving travel direction).

That the lighting unit is arranged no more than 140 cm higher with respect to the vertical direction than the floor area of the main control stand may mean in particular that a light exit surface through which the light provided by the lighting unit exits the lighting unit is arranged no more than 140 cm higher than the floor area. That the lighting unit is arranged no more than 140 cm higher with respect to the vertical direction than the floor area of the main control stand may mean in particular that a light-generating light source of the lighting unit is arranged no more than 140 cm higher with respect to the vertical direction than the floor area of the main control stand.

The floor area of the main control stand may be configured at least in part as a metal surface. A comparatively high portion of light is reflected from a metal surface, so that the light emitted by the lighting unit onto the floor area of the main control stand may still contribute to the illumination of the main control stand even after being reflected from the floor area. It would also be conceivable to have the floor area of the main control stand be formed, at least in sections, by a floor mat, such as a rubber mat, which may improve the operator's surefootedness on the main control stand.

As explained, the lighting unit is arranged not more than 140 cm higher with respect to a vertical direction than the floor area of the main control stand. According to some embodiments, the lighting unit is even arranged no more than 130 cm, or no more than 120 cm, or no more than 110 cm, or no more than 100 cm, or no more than 90 cm, or no more than 80 cm, or not more than 70 cm, or not more than 60 cm higher with respect to the vertical direction than the floor area of the main control stand.

As explained, the lighting unit is arranged such that at least 60 percent of the light output emitted by the lighting unit during operation falls onto the floor area of the main control stand. According to some embodiments, the lighting unit is arranged such that even at least 70 percent, or at least 75 percent, or at least 80 percent, or at least 90 percent of the light output emitted by the lighting unit during operation falls onto the floor area of the main control stand.

A main direction of emittance of the lighting unit may be inclined downward with respect to a horizontal plane. A main direction of emittance that is inclined downward with respect to a horizontal plane ensures that the operator on the main control stand is unlikely to be blinded, since the operator under normal conditions will not look into the lighting unit from below along the main direction of emittance if the lighting unit is arranged no more than 140 cm higher than the floor area of the main control stand. The main direction of emittance of the lighting unit may be the direction in which the highest light output is emitted. The main direction of emittance of the lighting unit may be at least substantially arranged centrally in an emittance volume of the lighting unit. The main direction of emittance of the lighting unit is inclined downward with respect to a horizontal plane preferably by at least 10 degrees, or by at least 20 degrees, or by at least 30 degrees, or by at least 40 degrees, or by at least 50 degrees, or by at least 60 degrees, or by at least 70 degrees, or by at least 80 degrees, or by about 90 degrees.

The road finisher may comprise an opaque upper shield which is arranged above the lighting unit and shields the lighting unit at least from a viewing direction from above. The opaque upper cover may prevent the operator from looking directly into the lighting unit from above and being blinded in the process.

The road finisher may comprise an opaque side shield which shields the lighting unit at least from a horizontal viewing direction. Shielding with respect to a horizontal viewing direction may prevent blinding people or road users in the vicinity of the road finisher. The horizontal viewing direction may be parallel to the paving travel direction of the road finisher. The horizontal viewing direction may be perpendicular to the paving travel direction of the road finisher. The horizontal viewing direction may have a component parallel to the paving travel direction of the road finisher and a component perpendicular to the paving travel direction of the road finisher.

The main control stand may comprise a control panel with control elements for controlling functions of the road finisher. The lighting unit may be mounted beneath the control panel. If the lighting unit is mounted beneath the control panel, the lighting unit is shielded by the control panel towards the top. An operator working at the control panel cannot look directly into the lighting unit. A lighting unit mounted beneath the control panel may provide indirect illumination of the main control stand. The lighting unit may use installation space otherwise unused below the control panel.

The main control stand may comprise a seat for an operator. In particular, an operator seated in the seat may operate control elements of the control panel. An imaginary linear connecting line between an upper end of a backrest of the seat and the lighting unit may run through the control panel or through a structure provided beneath the control panel, such as a holder for the control panel or a panel guide for the control panel. The control panel or the structure provided beneath the control panel may block an operator seated in the seat from having a direct view onto the lighting unit and thereby prevent the operator from being blinded. The upper end of the backrest may be defined by a backrest main body. The upper end of the backrest may be configured as the upper end of a headrest provided optionally.

The lighting unit may be mounted to an underside of a component of the road finisher. For example, the lighting unit may be mounted to an underside of the control panel. Alternatively, the lighting unit may be mounted to an underside of a holder for the control panel or a panel guide for sliding a control panel of the road finisher with respect to a sliding direction. The panel guide may enable, for example, the control panel provided at the main control stand to be slid transversely to the paving travel direction.

The floor area of the main control stand is preferably a walking surface and/or a tread surface and/or a standing surface for an operator of the road finisher.

A luminosity of the lighting unit may be individually adjustable. An adjustable luminosity makes it possible to adjust the lighting to the respective construction site environment or to the preferences of the operator. The luminosity may be set, for example, using the control panel. The luminosity may be effected, for example, by switching on or off individual light sources of the lighting unit or by dimming one or more light sources of the lighting unit.

A light color of the lighting unit may be individually adjustable. An adjustable light color makes it possible to adjust the lighting to the respective construction site environment or to the preferences of the operator. The light color may be set, for example, using the control panel.

The road finisher may comprise a brightness sensor, and a control device of the road finisher may be configured to adjust a luminosity of the lighting unit in dependence of a sensor output by the brightness sensor. For example, the control device of the road finisher may regulate the luminosity of the lighting unit into a predefined range or to a predefined value based on a sensor output by the brightness sensor. It may be achieved by way of the brightness sensor that an appropriate brightness is obtained without any active intervention on the part of the operator.

According to a further aspect, the disclosure relates to a road finisher with a material hopper for receiving paving material, a screed for compacting paving material, and a main control stand. The main control stand comprises a seat for an operator and a control panel with control elements for controlling functions of the road finisher. The road finisher comprises a lighting unit. An imaginary linear connecting line between an upper end of a backrest of the seat for the operator and the lighting unit runs through the control panel or through a structure provided beneath the control panel.

The control panel or the structure provided beneath the control panel may prevent an operator seated in the seat from looking directly into the lighting unit and being blinded as a result. The control panel or the structure provided beneath the control panel may shield the lighting unit. The control panel or the structure provided beneath the control panel may prevent a region of the main control stand located above the control panel from being illuminated excessively.

The structure provided beneath the control panel may be, for example, a holder for the control panel or a panel guide for the control panel. The panel guide may allow the control panel to be slid relative to a sliding direction which may run in particular transverse to the paving travel direction.

A main direction of emittance of the lighting unit is preferably oriented forward or rearward with respect to a paving travel direction of the road finisher. A main direction of emittance oriented forward means that people disposed behind the road finisher cannot be directly blinded by the lighting unit. A main direction of emittance oriented rearward means that people disposed in front of the road finisher cannot be directly blinded by the lighting unit. That the main direction of emittance of the lighting unit is oriented forward or rearward with respect to the paving travel direction does not preclude that the main direction of emittance may additionally be inclined with respect to a horizontal plane. The main direction of emittance of the lighting unit could also be oriented vertically downward. This also makes it possible to effectively avoid blinding people in the vicinity of the road finisher.

A main direction of emittance of the lighting unit may be inclined downward with respect to a horizontal plane. The main direction of emittance may be inclined with respect to a horizontal plane, for example by at least 10 degrees, or by at least 20 degrees, or by at least 30 degrees, or by at least 40 degrees, or by at least 50 degrees, or by at least 60 degrees, or by at least 70 degrees, or by at least 80 degrees, or by about 90 degrees.

The lighting unit may be mounted at the control panel. The lighting unit may in particular be mounted to an underside of the control panel.

The road finisher may comprise a panel guide for sliding the control panel with respect to a sliding direction. The lighting unit may be mounted to an underside of the panel guide.

According to a further aspect of the disclosure, a road finisher for paving a road surface on a subgrade is provided. The road finisher comprises a material hopper for receiving paving material, a screed for compacting paving material, a main control stand, and a subgrade lighting. The main control stand comprises an operating platform and a seat unit with a seat for an operator. The seat unit is movable between a first position and a second position. In the first position, the seat is disposed at least substantially within a width of the operating platform. The width of the operating platform relates to an extension in a transverse direction of the road finisher perpendicular to the paving travel direction, meaning to the left and the right as seen in the paving travel direction. In the second position, the seat projects laterally beyond the operating platform. The subgrade lighting is mounted to the seat unit. The subgrade lighting is configured to illuminate the subgrade in the second position of the seat unit.

The movability of the seat unit makes it possible to adapt the seating position of an operator to the requirements of the respective paving situation. When the seat unit is disposed in the first position, an operator seated in the seat has good access to control devices on the main control stand. In the first position of the seat unit, the operator in the seat may have a good forward view in the paving travel direction. When the seat unit is disposed in the second position, meaning it projects laterally beyond the operating platform, an operator seated in the seat has an improved view of the subgrade laterally beside the road finisher. The operator may look substantially laterally beside the road finisher directly downward, or downward forward or downward to the rear, and thereby has an improved view of the edge region of the paved road surface.

The illumination of the subgrade with the subgrade lighting makes it easier for the operator to follow processes on the ground when the seat unit is in the second position and thereby enables the operator to control the paving process in an improved and adapted manner, in particular on night construction sites. Since the subgrade lighting is mounted to the seat unit, it is moved along when the seat unit is moved to the second position. As a result, the subgrade lighting may be optimally positioned for illuminating the subgrade in the field of vision of an operator seated in the seat. When the seat unit is moved back to the first position, the subgrade lighting is moved along and is then relatively well protected against soiling and damage, in particular within the width of the operating platform.

The subgrade lighting is preferably disposed within the width of the operating platform when the seat unit is disposed in the first position. The subgrade lighting is preferably disposed laterally outside the operating platform when the seat unit is in the second position.

The subgrade lighting may be mounted at the underside of the seat unit. The subgrade lighting may illuminate the subgrade directly and efficiently from the underside of the seat unit. Mounting the subgrade lighting to an underside of the seat unit reduces the risk of people in the vicinity of the road finisher or other road users being blinded by the subgrade lighting.

The seat unit may comprise a console carrying the seat. The console may comprise, for example, a plate onto which the seat is mounted. The movability of the seat unit may be provided by the movability of the console. The subgrade lighting may be mounted in particular to the underside of the console.

The seat unit may be pivotable about a vertical axis between the first position and the second position. The seat unit may be slidable between the first position and the second position. Mixed forms are also conceivable in which a motion of the seat unit between the first position and the second position comprises pivoting, in particular about a vertical axis, and a translational motion.

In the first position of the seat unit, the seat may be oriented at least substantially in the paving travel direction of the road finisher. This gives an operator sitting in the seat an optimal view in the paving travel direction.

In the second position of the seat unit, the seat may be pivoted relative to the paving travel direction.

A main direction of emittance of the subgrade lighting is preferably inclined downward with respect to a horizontal direction by at least 30 degrees, or by at least 45 degrees, or by at least 60 degrees, or by at least 80 degrees, or by substantially 90 degrees. Direct and efficient illumination of the subgrade is achieved by the main direction of emittance of the subgrade lighting being inclined downward. In addition, the blinding effect for other road users is reduced.

The road finisher may comprise a control device that is configured to activate the subgrade lighting in an automated manner when the seat unit is moved to the second position. In this case, the operator only needs to move the seat unit to the second position if he wants to see the subgrade at the side of the road finisher. Manual activation of the subgrade lighting is no longer necessary. The control device may detect a motion of the seat unit to the second position and, based thereupon, activate the subgrade lighting in an automated manner.

Alternatively, the subgrade lighting could be activated manually or be activated or deactivated together with the machine lighting.

The main direction of emittance of the subgrade lighting may be adjustable. The main direction of emittance of the subgrade lighting may be adjusted, for example, in an automated manner by way of a control device or manually by the operator.

According to a further aspect, the disclosure relates to a road finisher for paving a road surface on a subgrade. The road finisher comprises a material hopper for receiving paving material, a screed for compacting paving material, a main control stand, a subgrade lighting, and a control device. The main control stand comprises an operating platform and a seat unit with a seat for an operator. The seat unit is movable between a first position and a second position. In the first position, the seat is disposed at least substantially within a width of the operating platform. In the second position, the seat projects laterally beyond the operating platform. The subgrade lighting is configured to illuminate the subgrade. The control device is configured to activate the subgrade lighting in an automated manner when the seat unit is moved to the second position.

In the second position of the seat unit, an operator seated in the seat has an improved view of the subgrade. It may be assumed that the operator would like to see the subgrade and observe it for better control of the paving process when the seat unit is moved to the second position. As a result of the automated activation of the subgrade lighting when the seat unit is moved to the second position, the observation of the subgrade is automatically facilitated by the illumination of the subgrade when the seat unit is moved to the second position. Manual activation of the subgrade lighting by the operator is not required.

The subgrade lighting may be arranged such that it illuminates the subgrade at a point which may be observed by the operator when he is seated in the seat while the seat unit is in the second position. In particular, the subgrade lighting in the second position of the seat unit may illuminate a work area of the screed.

The subgrade lighting may be mounted, for example, to the seat unit, to a chassis of the road finisher, to a roof of the main control stand, or to another component of the road finisher. The subgrade lighting may be mounted at the side of the road finisher.

The control device is preferably configured to deactivate the subgrade lighting in an automated manner when the seat unit is moved to the first position. Manual deactivation of the subgrade lighting may then be dispensed with.

The road finisher preferably comprises a sensor which is configured to detect a position of the seat unit. The control device may control the subgrade lighting based on an output from the sensor. The sensor may directly detect the position of the seat unit, for example, by detecting a component of the seat unit. Alternatively, indirect detection of the position of the seat unit would also be conceivable, for example, in that the sensor reacts to an actuation of a motion mechanism of the seat unit.

The motion of the seat unit between the first position and the second position may be to pivot about a vertical axis. The motion of the seat unit between the first position and the second position may be a sliding motion (translational motion). Mixed forms are also conceivable in which the motion of the seat unit between the first position and the second position comprises pivoting, in particular about a vertical axis, and a translational motion.

The control device of the road finisher may be configured to adapt an illumination area illuminated by the subgrade lighting in dependence of a paving width of the screed. For example, the control device may adapt the position and/or the size of the illumination area in dependence of the paving width of the screed. The paving width of the screed may be made available to the control device by user input or by the detection of a screed configuration. The illuminated illumination area may be effected for example, by changing a luminosity of a lighting unit of the subgrade lighting or by switching on or off one or more lighting elements of the subgrade lighting.

The main direction of emittance of the subgrade lighting may be adjustable, in particular in dependence of the paving width of the screed. The main direction of emittance of the subgrade lighting may be adjusted, for example, in an automated manner by way of a control device or manually by the operator. The control device may be configured to adjust a luminosity and/or a main direction of emittance of the subgrade lighting in dependence on the paving width of the screed.

Features, embodiments, or advantages described regarding one of the aspects of the disclosure may be transferred to and combined with the other aspects of the disclosure.

BRIEF DESCRIPTION OF THE DRAWINGS

The disclosure shall be further explained hereafter on the basis of embodiments with reference to the figures, where.

DETAILED DESCRIPTION

Figure 1:
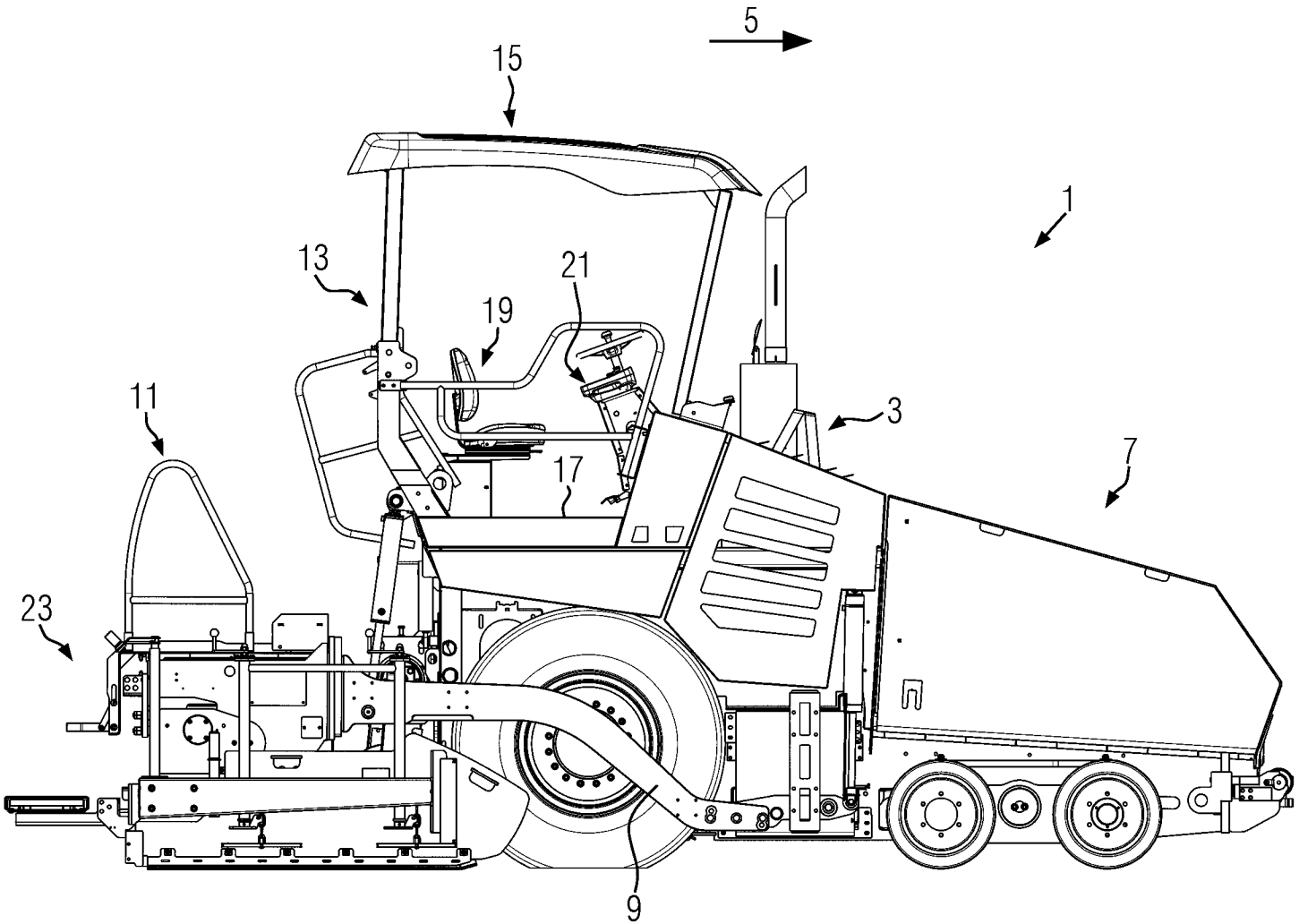
FIG. 1 shows a schematic side view of a road finisher according to an embodiment.

FIG. 1 shows a road finisher 1 according to an embodiment. Road finisher 1 comprises a towing vehicle 3 on which a material hopper 7 for receiving paving material is provided at the front with respect to a paving travel direction 5 of road finisher 1. A screed 11 for compacting the paving material is pulled behind towing vehicle 3 by way of traction bars 9. A main control stand 13 is provided on towing vehicle 3. Main control stand 13 provides a raised operating location for an operator on road finisher 1. From main control stand 13, the operator may see the surroundings of road finisher 1 in all directions. Main control stand 13 comprises a roof 15 or protecting the operator from the elements. Main control stand 13 comprises a floor area 17 on which the operator may stand. Floor area 17 may be configured, for example, as a metal surface, at least in sections. Floor area 17 may also be formed at least in sections by a layering, such as a rubber mat or the like. Main control stand 13 comprises a seat 19 for the operator. In addition, a control panel 21 with control elements for controlling functions of road finisher 1 is provided at main control stand 13. Control panel 21 may comprise, for example, actuatable buttons or switches. An operator seated on seat 19 may operate the control elements of control panel 21. In the embodiment shown, an outside control stand 23 is further provided at screed 11.

Figure 2:
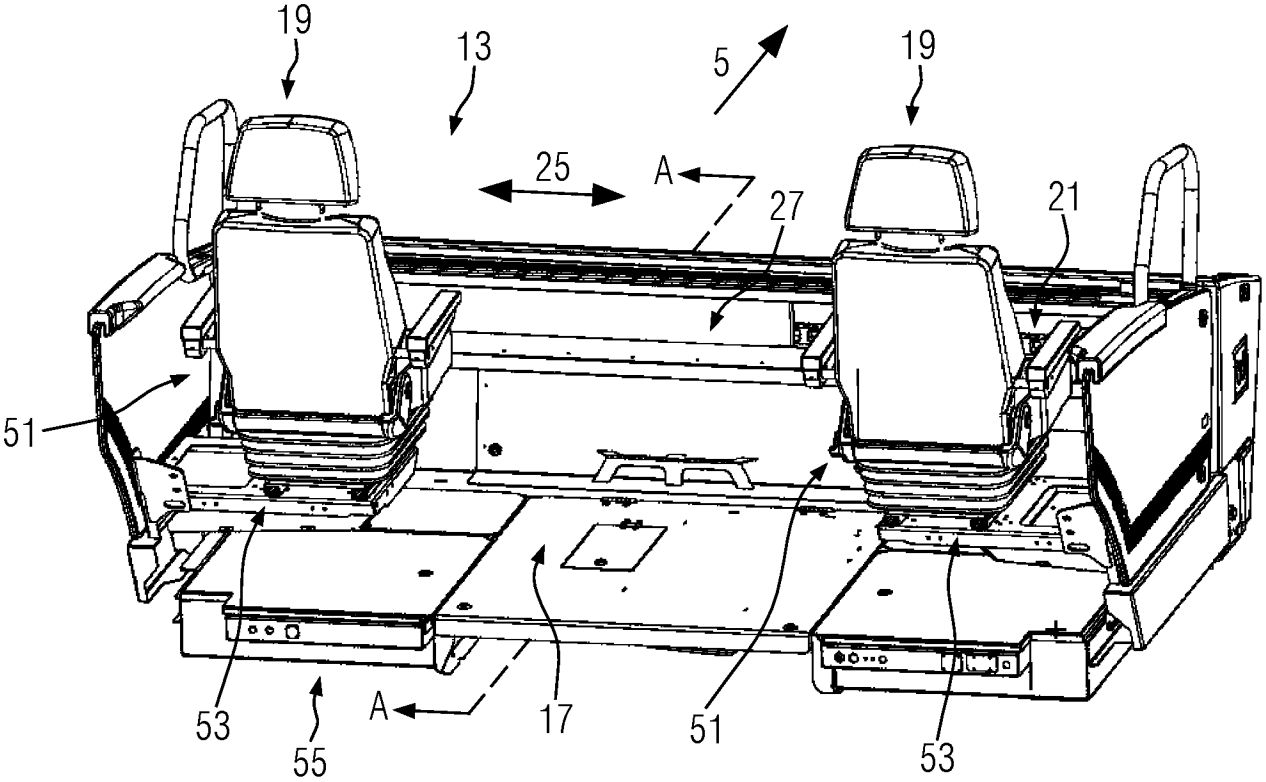
FIG. 2 shows a schematic perspective view of an occupational region for an operator on the main control stand of a road finisher according to an embodiment.

As shown in FIG. 2, main control stand 13 illustrated in the embodiment comprises two seats 19 which are spaced from one another with respect to a horizontal transverse direction 25 that is perpendicular to paving travel direction 5. Depending on the viewing point preferred for the specific paving situation, the operator may take a seat on one of the two seats 19. If the operator wishes to observe, for example, a road lane edge which in paving travel direction 5 is on the right-hand side during the paving process, then the operator may advantageously take a seat on seat 19 on the right-hand side. In the embodiment shown, control panel 21 is mounted to a panel guide 27 so as to be slidable. Panel guide 27 extends along transverse direction 25 from seat 19 on the left-hand side to seat 19 on the right-hand side. By sliding control panel 21 along panel guide 27, control panel 21 may be moved in front of the seat 19 on which the operator is currently seated. Alternatively, it would of course also be conceivable to provide only one seat 19 and to provide control panel 21 in a fixed or slidable manner in front of seat 19, for example by way of a holder.

Figure 3:
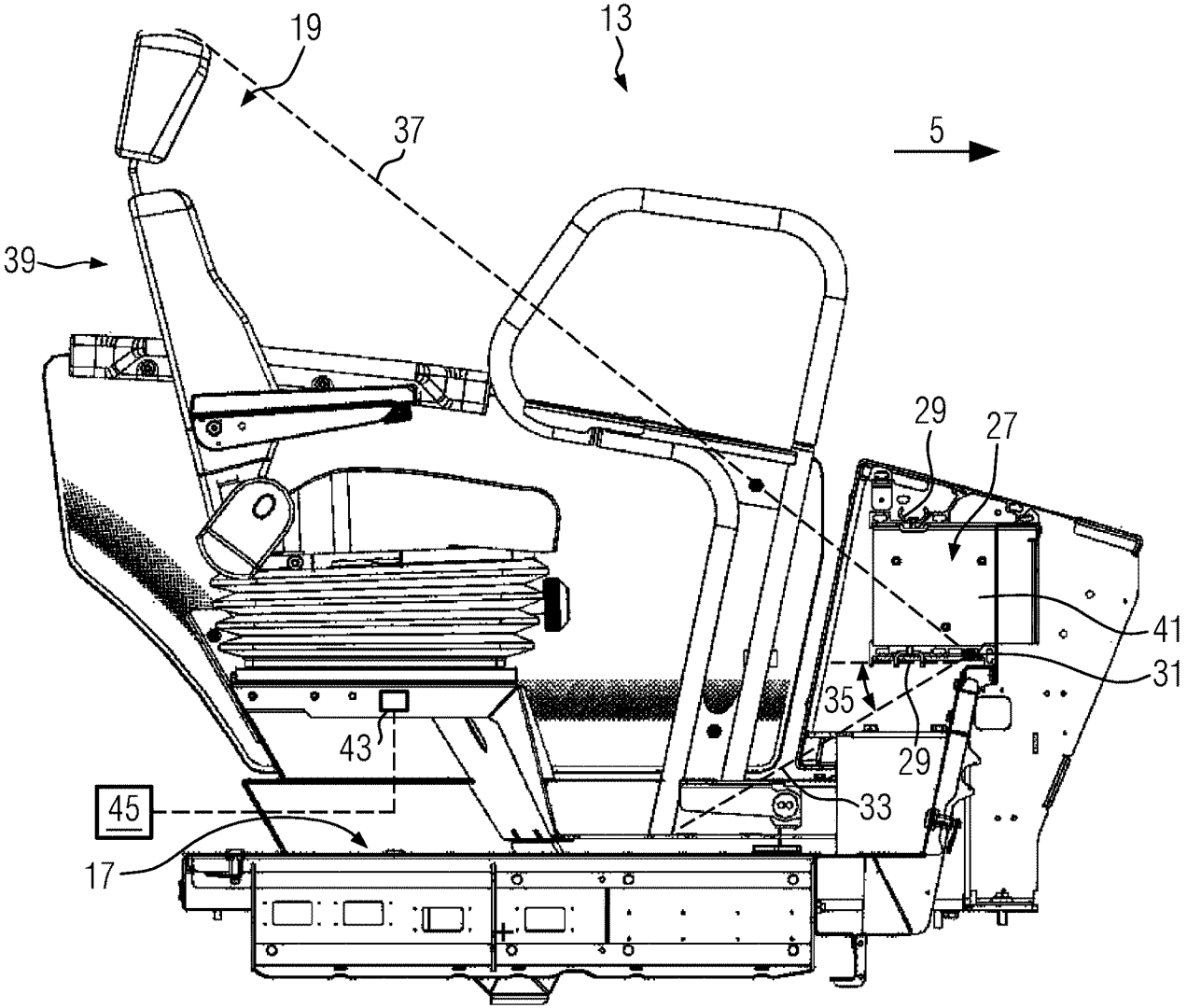
FIG. 3 shows a schematic sectional view through the main control stand of a road finisher according to an embodiment with a lighting for the main control stand.

FIG. 3 shows a schematic representation of a section (section A-A in FIG. 2) through main control stand 13 in a viewing direction along transverse direction 25. As may be seen in FIG. 3, panel guide 27 extends with respect to paving travel direction 5 in front of seat 19 in transverse direction 25. In the situation shown in FIG. 3, control panel 21 is in front of the seat 19 which is not illustrated and is therefore not visible in the figure. Control panel 21 is mounted in guide rails 29 of panel guide 27 so as to be slidable along transverse direction 25. Control panel 21 is disposed lying substantially on top of panel guide 27.

As may be seen from FIG. 3, a lighting unit 31 is mounted underneath panel guide 27. In the embodiment shown, lighting unit 31 is configured as an LED strip which extends underneath panel guide 27 along panel guide 27 in transverse direction 25. The LED strip preferably extends at least substantially along the entire extension length of panel guide 27 in transverse direction 25.

Lighting unit 31 is used to illuminate main control stand 13. In particular, if road finisher 1 is to be operated at dusk or at night, lighting unit 31 may be switched on to make it easier for the operator to operate road finisher 1 from main control stand 13. Mounting lighting unit 31 to the underside of panel guide 27 results in a relatively low mounting height of lighting unit 31 above floor area 17 of main control stand 13. Lighting unit 31 is no more than 140 cm higher with respect to a vertical direction than floor area 17 of main control stand 13. According to some embodiments, lighting unit 31 is even no more than 130 cm, or no more than 120 cm, or no more than 110 cm, or no more than 100 cm, or no more than 90 cm, or no more than 80 cm, or not more than 70 cm, or not more than 60 cm higher with respect to the vertical direction than floor area 17 of main control stand 13.

Lighting unit 31 is arranged such that at least 60 percent of the light output emitted by lighting unit 31 during operation falls onto floor area 17 of main control stand 13. According to some embodiments, lighting unit 31 is arranged such that even at least 70 percent, or at least 75 percent, or at least 80 percent, or at least 90 percent of the light output emitted by lighting unit 31 during operation falls onto floor area 17 of main control stand 13.

A main direction of emittance 33 of lighting unit 31 is inclined downward with respect to a horizontal plane. Main direction of emittance 33 of lighting unit 31 in the illustrated embodiment is inclined downward by an angle 35 with respect to a horizontal plane. Angle 35 may be, for example, at least 10 degrees, or at least 20 degrees, or at least 30 degrees, or at least 40 degrees, or at least 50 degrees, or at least 60 degrees, or at least 70 degrees, or at least 80 degrees, or approximately 90 degrees. Angle of inclination 35 of main direction of emittance 33 with respect to the horizontal plane may be selected by suitably mounting lighting unit 31.

An indirect illumination of main control stand 13 from below is created as a result of mounting lighting unit 31 inclined downward with respect to a horizontal plane at a comparatively low height above floor area 17.

An imaginary linear connecting line 37 between an upper end of a backrest 39 of seat 19 and lighting unit 31 runs through control panel 21 or, as in the present case, through a structure (panel guide 27) provided underneath control panel 21. An operator seated on seat 19 may therefore not unintentionally look directly into lighting unit 31, which could lead to the operator being blinded.

In the embodiment shown, panel guide 27 and control panel 21 themselves represent an opaque upper shield which shields lighting unit 31 from a viewing direction from above. A lateral end plate 41 of panel guide 27 represents an opaque side shield which shields lighting unit 31 from a horizontal viewing direction and thereby prevents people who are in the vicinity of road finisher 1 from being blinded.

The luminosity and/or the light color of lighting unit 31 may preferably be adjusted individually, for example by way of control elements on control panel 21. Road finisher 1 may comprise a brightness sensor 43 which in the embodiment shown is mounted in the region of seat 19. A control device 45 of road finisher 1 may be configured to adjust a luminosity of lighting unit 31 in dependence of a sensor output by brightness sensor 43. For example, control device 45 may actuate lighting unit 31 based on the sensor output in order to regulate the brightness in the region of brightness sensor 43 into a predetermined range or to a predetermined value.

Instead of the LED strip or in addition to the LED strip, lighting unit 31 may also contain other light sources, such as, for example, one or more light bulbs or one or more gas discharge lamps.

As shown in FIG. 2, seats 19 are each part of a seat unit 51. In addition to respective seat 19, seat units 51 comprise a console 53 on which seat 19 is mounted. Console 53 may comprise, for example, a plate which carries seat 19. Both seat units 51 are shown in a first position in FIG. 2. In the first position, seat unit 51 may be oriented substantially in paving travel direction 5 of road finisher 1. An operator seated on seat 19 looks forward along paving travel direction 5 of road finisher 1. As shown in FIG. 2, seat 19 of a seat unit 51 is in the first position of seat unit 51 at least substantially or completely within a width of an operating platform 55 of main control stand 13. This does not necessarily preclude individual elements of seat 19 from projecting laterally (with respect to transverse direction 25) beyond operating platform 55. For example, an armrest of seat 19 could project in part beyond operating platform 55. However, the main part of seat 19 in the first position of seat unit 51 is disposed within the width of operating platform 55. In particular, a seat base of seat 19 in the first position of seat unit 51 is disposed within the width of operating platform 55.

Figure 4:
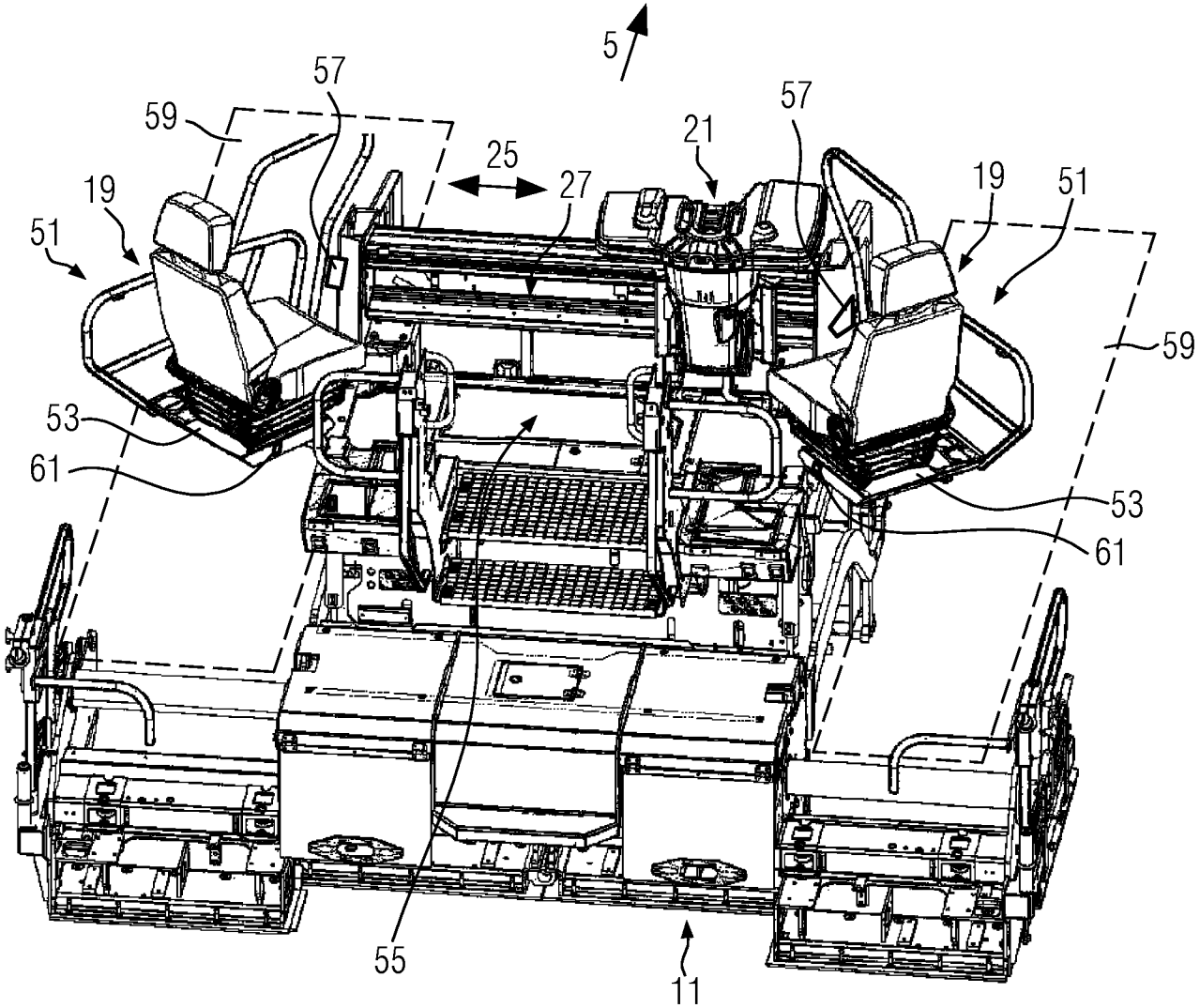
FIG. 4 shows a schematic perspective view of a rear area of a road finisher at an angle from above according to an embodiment with a pivotable seat unit and subgrade lighting.

According to embodiments, at least one of seat units 51 is movable from the first position to a second position. FIG. 4 shows a situation in which both seat units 51 have been moved to their second position. In the second position of a seat unit 51, respective seat 19 projects laterally beyond operating platform 55. In particular in the second position, at least one third, or at least two thirds, or at least three quarters of the seat base of seat 19 may project laterally with respect to transverse direction 25 beyond operating platform 55 of main control stand 13. In the second position of seat unit 51, an operator seated on respective seat 19 has an improved view of the subgrade in the region of road finisher 1 laterally to the side of road finisher 1.

In the embodiment shown, seat unit 51 is pivoted about a vertical axis between the first position and the second position. Alternatively, seat unit 51 could be slidable between the first position and the second position. Mixed forms are also conceivable in which the motion of seat unit 51 between the first position and the second position comprises pivoting, in particular about a vertical axis, and a translational motion.

According to embodiments, road finisher 1 comprises a subgrade lighting 57. In the embodiment according to FIG. 4, subgrade lighting 57 is mounted to the side of the chassis of road finisher 1 and illuminates the subgrade in a work area 59 of screed 11.

According to embodiments, control device 45 of road finisher 1 is configured to activate subgrade lighting 57 in an automated manner when seat unit 51 is moved to the second position. In this way, it may be ensured that work area 59 of screed 11 is illuminated and may therefore be easily seen when seat unit 51 is in the second position.

Control device 45 may additionally be configured to deactivate subgrade lighting 57 in an automated manner when seat unit 51 is moved to the first position.

Road finisher 1 may comprise a sensor 61 which detects the position of seat unit 51. Control device 45 may activate or deactivate subgrade lighting 57 based on an output by sensor 61.

Control device 45 may take into account the output by brightness sensor 43 when controlling subgrade lighting 57. For example, if brightness sensor 43 detects a brightness below a certain threshold value, control device 45 may control subgrade lighting 57, as described, based on the position of seat unit 51. If brightness sensor 43 detects a brightness value above the specific threshold value, control device 45 may deactivate subgrade lighting 57 regardless of the position of seat unit 51 or leave it deactivated.

A main direction of emittance of subgrade lighting 57 may preferably be inclined downward with respect to a horizontal direction by at least 30 degrees, or by at least 45 degrees, or by at least 60 degrees, or by at least 80 degrees, or by substantially 90 degrees.

The main direction of emittance of subgrade lighting 57 may be adjustable. The main direction of emittance of subgrade lighting 57 may be adjusted, for example, in an automated manner by way of control device 45 or manually by the operator. Control device 45 may be configured to adapt an illumination area illuminated by subgrade lighting 57 in dependence of a paving width of the screed. For example, control device 45 may adapt the position and/or the size of the illumination area in dependence of the paving width of the screed. The paving width of the screed may be made available to control device 45 by user input or by detection of a screed configuration. The illuminated illumination area may be effected for example, by changing a luminosity of a lighting unit of subgrade lighting 57 or by switching on or off one or more lighting elements of subgrade lighting 57.

Figure 5:
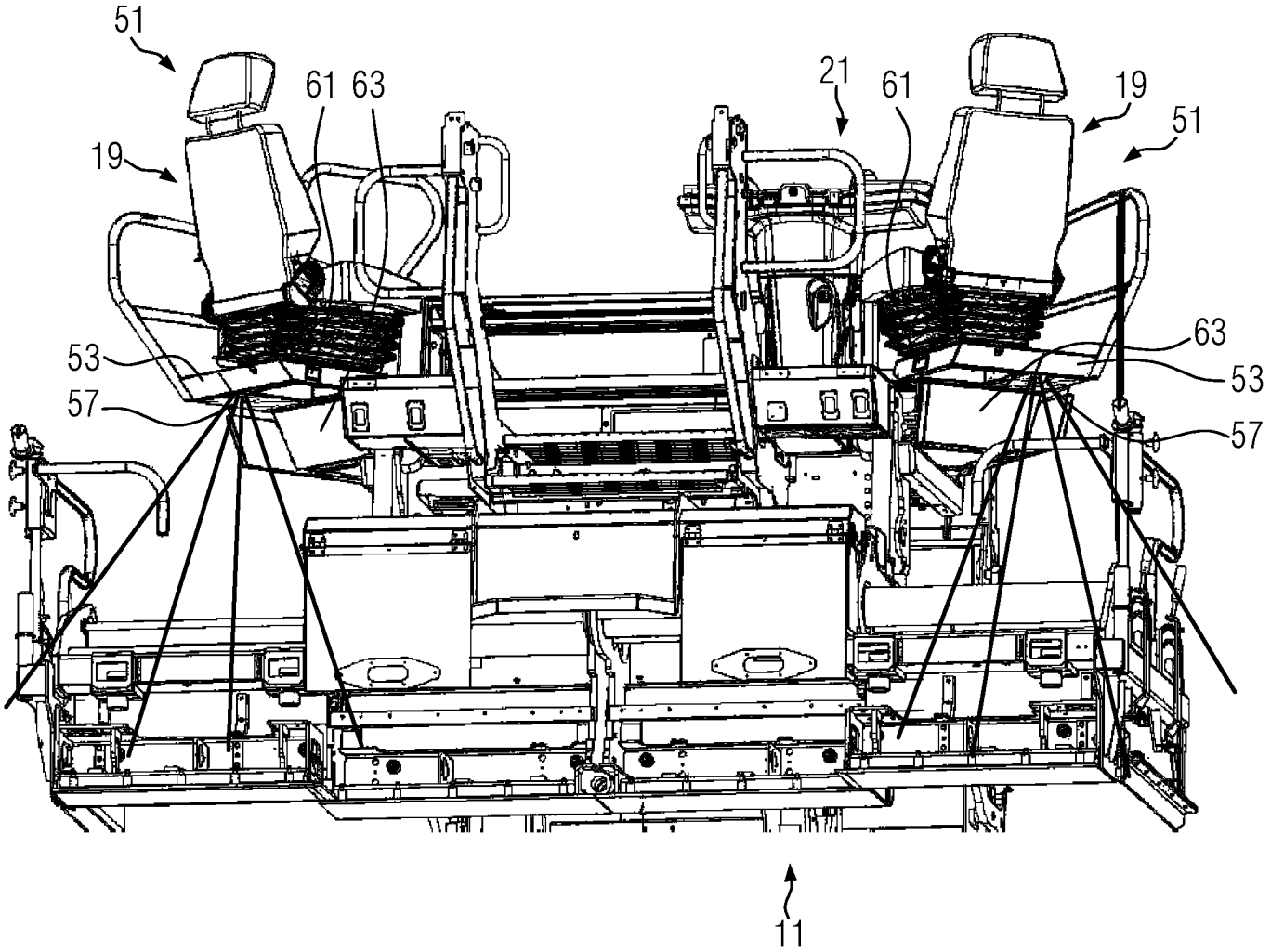
FIG. 5 shows a schematic perspective view of the rear area of the road finisher shown in FIG. 4 at an angle from below.

FIG. 5 shows an alternative embodiment in which subgrade lighting 57 is mounted to seat unit 51. In particular, subgrade lighting 57 is mounted underneath console 53 of seat unit 51. In the second position of seat unit 51, subgrade lighting 57 may illuminate work area 59 of screed 11 particularly efficiently due to its positioning. In the illustrated embodiment, console 53 of seat unit 51 comprises a shield 63 which shields subgrade lighting 57 from a horizontal viewing direction, in the embodiment shown from the front with respect to paving travel direction 5. In this way, blinding people in the vicinity of road paver 1 or other road users may be prevented particularly efficiently.

As described, subgrade lighting 57 may be controlled in an automated manner based on the position of seat unit 51. However, this is not absolutely necessary. Alternatively, for example, a switch for activating or deactivating subgrade lighting 57 could be provided.

Features relating to the illumination of main control stand 13 by lighting unit 31 have been described. In addition, features relating to the illumination of the subgrade in the region of road finisher 1 by subgrade lighting 57 have been described. Lighting unit 31 and subgrade lighting 57 could be provided together on a road finisher 1. However, it is also conceivable to provide only lighting unit 31 for illuminating main control stand 13 or, alternatively, subgrade lighting 57 for illuminating the subgrade.

What is claimed is:

1. A road finisher comprising:

a material hopper for receiving paving material;

a screed for compacting paving material; and a main control stand providing an operating location for an operator on the road finisher, wherein the main control stand comprises a floor area, wherein the road finisher comprises a lighting unit, wherein the lighting unit is arranged no more than 140 cm higher with respect to a vertical direction than the floor area of the main control stand, and wherein the lighting unit is arranged such that at least 60 percent of the light output emitted by the lighting unit during operation falls onto the floor area of the main control stand.

2. The road finisher according to claim 1, wherein a main direction of emittance of the lighting unit is inclined downward with respect to a horizontal plane by at least 10 degrees.

3. The road finisher according to claim 1, further comprising an opaque upper shield which is arranged above the lighting unit and shields the lighting unit at least from a viewing direction from above.

4. The road finisher according to claim 1, further comprising an opaque side shield which shields the lighting unit at least from a horizontal viewing direction.

5. The road finisher according to claim 1, further comprising a towing vehicle, wherein the screed is connected to the towing vehicle to be pulled along behind the towing vehicle, and wherein the main control stand is arranged on the towing vehicle, wherein the main control stand further comprises a control panel with control elements for controlling functions of the road finisher and the lighting unit is mounted beneath the control panel.

6. The road finisher according to claim 5, wherein the main control stand further comprises a seat for an operator, and an imaginary linear connecting line between an upper end of a backrest of the seat and the lighting unit runs through the control panel or through a structure provided beneath the control panel.

7. The road finisher according to claim 1, wherein the lighting unit is mounted to an underside of a component of the road finisher.

8. The road finisher according to claim 1, wherein the floor area of the main control stand is a walking surface and/or a tread surface and/or a standing surface for an operator of the road finisher.

9. The road finisher according to claim 1, wherein a luminosity and/or a light color of the lighting unit is adjustable individually.

10. The road finisher according to claim 1, further comprising a brightness sensor, wherein a control device of the road finisher is configured to adjust a luminosity of the lighting unit in dependence on a sensor output by the brightness sensor.

11. The road finisher of claim 1, further comprising a towing vehicle, wherein the screed is connected to the towing vehicle to be pulled along behind the towing vehicle, and wherein the main control stand is arranged on the towing vehicle.

12. A road finisher comprising:

a material hopper for receiving paving material;

a screed for compacting paving material;

a main control stand with a seat for an operator and with a control panel with control elements for controlling functions of the road finisher, the seat having a backrest with an upper end; and a lighting unit, wherein an imaginary linear connecting line between the upper end of the backrest and the lighting unit runs through the control panel or through a structure provided beneath the control panel; and wherein a main direction of emittance of the lighting unit is inclined downward with respect to a horizontal plane.

13. The road finisher according to claim 12, wherein a main direction of emittance of the lighting unit is oriented forward or rearward with respect to a paving travel direction of the road finisher.

14. The road finisher according to claim 12, wherein the lighting unit is mounted to the control panel.

15. The road finisher according to claim 12, further comprising a panel guide for sliding the control panel with respect to a sliding direction, the lighting unit mounted to an underside of the panel guide.

* * * * *